US005375926A

United States Patent [19]

Omasa

[11] Patent Number: 5,375,926

[45] Date of Patent: Dec. 27, 1994

[54] APPARATUS FOR MIXING AND DISPENSING FLUID BY FLUTTER OF VIBRATING VANES

[75] Inventor: Ryushin Omasa, Kanagawa, Japan

[73] Assignee: Nihon Techno Kabushiki Kaisha, Tokyo, Japan

[21] Appl. No.: 119,688

[22] Filed: Sep. 13, 1993

[30] Foreign Application Priority Data

Sep. 14, 1992 [JP] Japan ..... 4-286544

[51] Int. Cl.[5] ..... B01F 11/00

[52] U.S. Cl. ..... 366/118; 366/343

[58] Field of Search ..... 366/256, 255, 257, 260, 366/108, 117, 116, 118, 600, 329, 343

[56] References Cited

U.S. PATENT DOCUMENTS

| | | | |
|---|---|---|---|
| 1,116,230 | 11/1914 | Boyd | 366/256 |
| 3,166,222 | 1/1965 | Schrader | 366/108 |
| 3,498,384 | 3/1970 | Ogura | 366/108 |
| 3,567,185 | 3/1971 | Ross | 366/118 |

*Primary Examiner*—Robert W. Jenkins

*Attorney, Agent, or Firm*—Henderson & Sturm

[57] ABSTRACT

An apparatus for mixing and dispersing a fluid in a container having an oscillation shaft for transmitting the oscillation generated by an oscillation generating device in the axial direction thereof, oscillation vanes adapted to be vibrated by the oscillation of the oscillation shaft is fixed, and an oscillation absorption mechanism interposed between the oscillation generating device and the container.

21 Claims, 11 Drawing Sheets

APPARATUS FOR MIXING AND DISPENSING FLUID BY FLUTTER OF VIBRATING VANES

BACKGROUND OF THE INVENTION

1. Field of the Invention

This invention relates to an apparatus for mixing and dispersing a fluid such as liquid, powder, or mixture thereof in a container. More particularly, this invention relates to an apparatus for mixing and dispersing a fluid such as liquid, powder, or mixture thereof in a container, such as a tank or a mixing tank incorporated in a production line by vibrating vibration vanes in the container.

2. Description of the Related Art

Heretofore, agitational mixers have been used for the manufacture of various chemical products, such as cosmetic articles, foodstuffs, medicines and drugs, coating materials, and inks and for the agitational mixture of materials for surface treatment.

The agitational mixers include those utilizing the rotation of stirring vanes, those having a stirring shaft coincident with the central axis of a container for the fluid under treatment, those having a stirring shaft inclined relative to the central axis of the container, and those having a stirring shaft disposed on a lateral wall of the container, for example. Some of the agitational mixers are provided with means for moving the container itself, as by imparting rotation to a cylindrical container. Part of the agitational mixers use such means as pumps, nozzles, and orifices for fluidifying a liquid. Some other agitational mixers are adapted to blow air in the tank as through a nozzle formed in the bottom part of the tank.

Among other agitational mixers, the stirrers which are operated by the rotation of rotary stirring vanes are used prevalently on the commercial basis.

The stirrers provided with rotary vanes, however, have various drawbacks as discussed below. The mixture emanating from such a stirrer, therefore, must be dispersed by additional use of a dispersing device, such as a roll mill, a sand grinder, or a colloid mill.

(1) The conventional stirrer provided with rotary vanes, when desired to mix a liquid homogeneously with a fine powder insoluble in the liquid, is at a disadvantage in allowing the produced mixture to separate quickly into the powder and the liquid after the stirring is stopped.

(2) This stirrer has the disadvantage that since the stirring is not easily effected in the bottom part of a container, the fine powder is not completely dispersed but is allowed to sediment in the bottom part.

(3) The stirrer sustains the resistance of an initial load necessary for rotational flow of the entire liquid and requires extra electric power during the initial stage of its operation.

In this case, the stirrer is enabled to produce a stirring motion with uniform electric power by gradually introducing the liquid to the site of agitation. This gradual addition of the liquid consumes time and labor to a very great extent.

(4) This stirrer tends to generate a whirlpool in the central part thereof and engulf air in the whirlpool and, as a result, impart a chemical influence to the liquid being stirred.

(5) The stirrer, when used for mixing two species of powder, fails to effect homogeneous mixture.

(6) Generally, owing to the load which is exerted upon the site of stirring, this stirrer can generate idle rotation when the part of the stirring vanes immersed in the liquid is small. Thus, the operation of this stirrer requires a constant test of such factors as amount of the liquid under treatment.

(7) As respects the number of revolutions per unit time, the stirrer generally encounters difficulty in producing a rotation at a high rate and, more often than not, generates only slow stirring. Since the stirrer is typically capable of about 300 revolutions per minute, it calls for a long time for producing desired stirring.

When the stirrer is used for dispersing an insoluble powder in a liquid, therefore, the time required for thorough mixture is further elongated.

(8) When the contents of a relatively large tank are required to be homogeneously stirred, it becomes necessary to use simultaneously several stirrers provided with rotary vanes and arranged efficiently.

(9) When the container to be used happens to have a circular cross section, it must be provided on the inner wall thereof with special means for inhibiting rotation of the contents thereof such as, for example, a baffle plate.

SUMMARY OF THE INVENTION

The present invention has been produced for the purpose of solving the problems described above.

The present invention is directed to providing an apparatus for mixture and dispersion which is capable of consistently effecting uniform mixture and dispersion.

The present invention is also directed to providing an apparatus for mixture and dispersion which prevents the fluid produced by the mixture and dispersion from quickly separating into the component materials of the fluid after completion of the mixture and dispersion.

The present invention is also directed to providing an apparatus for mixture and dispersion which allows desired mixture and dispersion to occur throughout the entire inner volume of the container and prevents the occurrence of sediment in the bottom part of the container.

The present invention is also directed to providing an apparatus for mixture and dispersion which requires only very small motive power for the mixture and dispersion.

The present invention is also directed to providing an apparatus for mixture and dispersion which is incapable of exerting any adverse chemical effect on the fluid under treatment.

The present invention is directed to providing an apparatus for mixture and dispersion which is capable of infallibly producing effective mixture and dispersion between different species of powder.

The present invention is also directed to providing an apparatus for mixture and dispersion which obviates the necessity for checking the amount of the fluid under treatment for the sake of preventing idle rotation of the stirring vanes.

The present invention is also directed to providing an apparatus for mixture and dispersion which requires only a very short time for thorough mixture and dispersion.

The present invention is also directed to providing an apparatus for mixture and dispersion which operates effectively with small electric power consumption.

The tenth object of this invention is to provide such an apparatus for mixture and dispersion that use of one apparatus suffices for the treatment of a fluid in a large tank.

The present invention is also directed to providing an apparatus for mixture and dispersion which obviates the necessity for providing the container on the inner wall thereof with a special member such as, for example, a baffle plate.

The present invention is also directed to providing an apparatus for mixture and dispersion which can be attached directly to a container, can effect desired mixture and dispersion by the use of an ordinary container, and can be used as a premixing device without leaving behind any appreciably large load in the subsequent steps.

More specifically, the present invention is directed to providing an apparatus for mixing and dispersing a fluid in a container, which apparatus comprises an oscillation generating device for generating oscillation, an oscillation shaft for transmitting the oscillation generated by the oscillation generating device in an axial direction, one or more oscillation vanes fixed on the oscillation shaft and adapted to vibrate by dint of the oscillation of the oscillation shaft, and an oscillation absorption mechanism interposed between the oscillation generating device and the container.

In this invention, the container is provided in the opening part thereof with a supporting base and the supporting base is so adapted that the apparatus of this invention for mixture and dispersion is detachably attached to the supporting base. The oscillation shaft of the apparatus of this invention for mixture and dispersion is inserted in the container so that the oscillation vanes assume their position inside the fluid held in the container. When the oscillation generating device is actuated and the oscillation shaft is consequently oscillated in the axial direction, the oscillation vanes are caused to vibrate because they are fixed to the oscillation shaft and the fluid in the container is mixed and dispersed as a result of the oscillation.

Further, since the apparatus of this invention for mixture and dispersion is supported and fixed on the container through the medium of the oscillation absorbing mechanism, the oscillation produced by the operation of the oscillation generating device is absorbed by the oscillation absorbing mechanism and, therefore, the transmission of this oscillation to the container is substantially nil or very little.

As a result, the fluid in the container is mixed and dispersed by the oscillation of the oscillation vanes with unusually high efficiency.

This exceptionally high efficiency of the mixture and dispersion may be logically explained by a postulate that the oscillation of the oscillation vanes is transmitted uniformly to all the parts of the fluid held in the container and enabled to generate a small rotary flow of the fluid and give rise to a collection of small rises of the surface of the fluid possibly to the extent of promoting the mixture and dispersion.

When the fluid in the container happens to be a mixture of liquid with powder, the oscillation of the fluid generated by the oscillation vanes enables the liquid to permeate the interstices between adjacent powder particles and discourages the occurrence of secondary agglomeration of powder particles into wet clusters.

As a result, the powder in the fluid under treatment is retained in a suspended state for a long time without succumbing to sedimentation.

The air entrapped in minute pores of the powder itself is expelled from the powder by the oscillation of the fluid.

When the fluid in the container is a mixture of liquid with powder, a mixture of liquid with liquid, or a mixture of powder with powder, the mixture and dispersion desired for purposes of the present invention can be effected from the beginning of the treatment with a fixed magnitude of oscillation. Virtually no need is felt for paying any consideration to the problem of initial increase of resistance of the load.

When the fluid in the container is a mixture of powder with powder, the oscillation of the fluid decreases the interstices which intervene between adjacent powder particles.

DESCRIPTION OF PREFERRED EMBODIMENT

Now, the embodiments of this invention will be described below with reference to the accompanying drawings.

Figure 1:
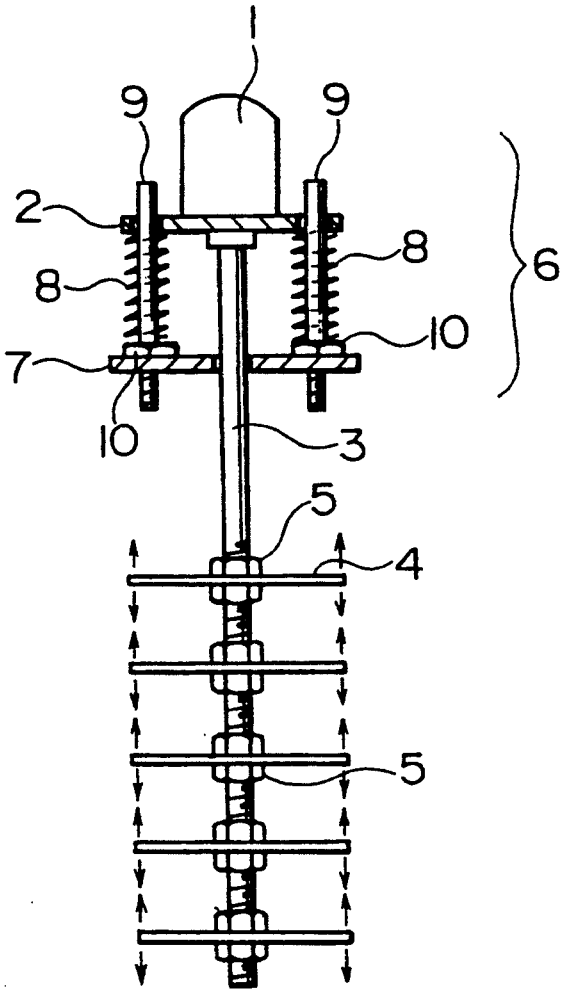
FIG. 1 is a front view of an apparatus for mixture and dispersion as one embodiment of this invention.

FIG. 1 is a front view of an apparatus for mixture and dispersion as one embodiment of this invention.

In the diagram, 1 stands for an oscillation motor for generating oscillation. This oscillation motor is of the industrial grade having an output of 0.15 kW, for example. The oscillation motor 1 is fixed on a base plate 2.

To the shaft of the oscillation motor 1, an oscillation shaft 3 for transmitting the generated oscillation in the axial direction is fixed.

To the oscillation shaft 3, a plurality of, and preferably five oscillation vanes 4 adapted to be vibrated by the oscillation of the oscillation shaft 3 are fixed as spaced with a prescribed interval.

The fixation of these oscillation vanes 4 is attained by the use of an oscillation vane fixing device 5 such as, for example, a nut.

The oscillation vanes 4 are made of a thin metallic material. The metallic materials which are effectively usable herein include titanium, aluminum, copper, iron and steel, and stainless steel, and alloys thereof, for example. Materials of synthetic resin, rubber, etc. which have elasticity are similarly usable.

The thickness of the oscillation vanes 4 is 1.5 mm. Though no particular restriction is imposed on the thickness, it is generally desired to be in the range of 1 to 2 mm for the sake of enhancing the efficiency with which the transmission of the oscillation energy is attained. The reason for this specific range of thickness is that the effect of oscillation is degraded when the thickness is unduly large. When the oscillation vanes are made of synthetic resin or rubber possessing elasticity, the thickness of the oscillation vanes, though not particularly restricted, is desired similarly to be in the range of 0.2 to 2 mm.

Figure 2:
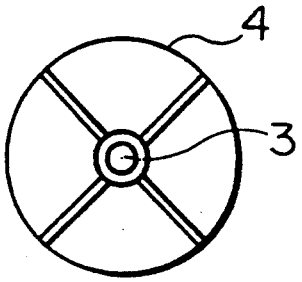
FIG. 2 is a plan view of oscillation vanes in the apparatus for mixture and dispersion as one embodiment of this invention.
Figure 3:
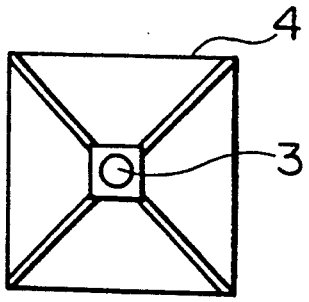
FIG. 3 is a plan view illustrating another example of the oscillation vanes.
Figure 4:
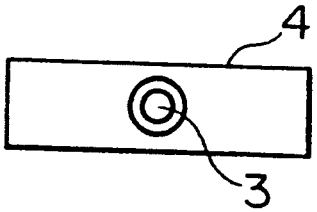
FIG. 4 is a plan view illustrating yet another example of the oscillation vanes.
Figure 5:
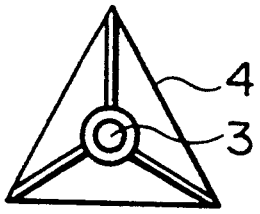
FIG. 5 is a plan view illustrating still another example of the oscillation vanes.

The oscillation vanes 4 have the shape of a circle divided into four equal sectors as illustrated in FIG. 2. Otherwise, they may have the shape of a square divided into a plurality of triangles, and preferably four equal triangles as illustrated in FIG. 3. The oscillation vanes 4 may be shaped like a rectangle as illustrated in FIG. 4. Alternatively, they may have the shape of a triangle divided into three equal triangles as illustrated in FIG. 5.

Figure 6:
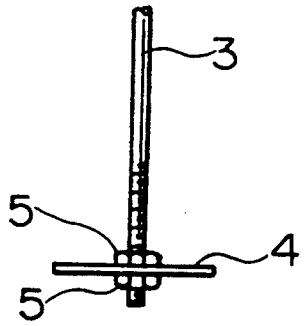
FIG. 6 is a front view illustrating one state of disposing the oscillation vanes in place.
Figure 7:
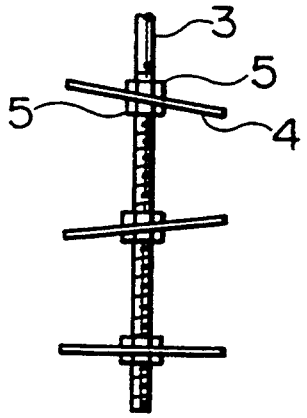
FIG. 7 is a front view illustrating another state of disposing the oscillation vanes in place.
Figure 8:
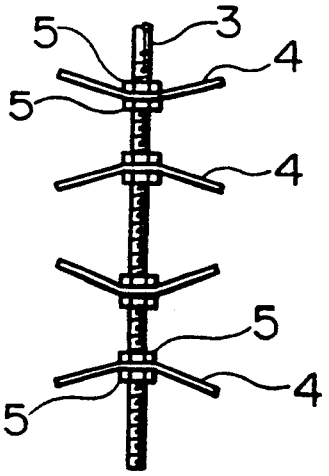
FIG. 8 is a front view illustrating yet another state of disposing the oscillation vanes in place.

The oscillation vanes 4 are each disposed on a plane which intersects the oscillation shaft 3 perpendicularly as illustrated in FIG. 6. The oscillation vanes 4 may be disposed on a plane which forms a prescribed angle with the plane perpendicularly intersecting the vibration shaft 3 as illustrated in FIG. 7 or FIG. 8. This angle is desired to be in the range of 5 degrees to 30 degrees. The flow of the fluid generated by the stirring within the tank can be optimized by suitable alteration of this angle.

For the purpose of precluding the transmission of the oscillation of the oscillation motor 1 to the container side, the oscillation motor 1 is amounted on the container through the medium of an oscillation absorption mechanism 6 which has the oscillation motor 1 supported fast on the upper surface of base plate 2 thereof.

Figure 18:
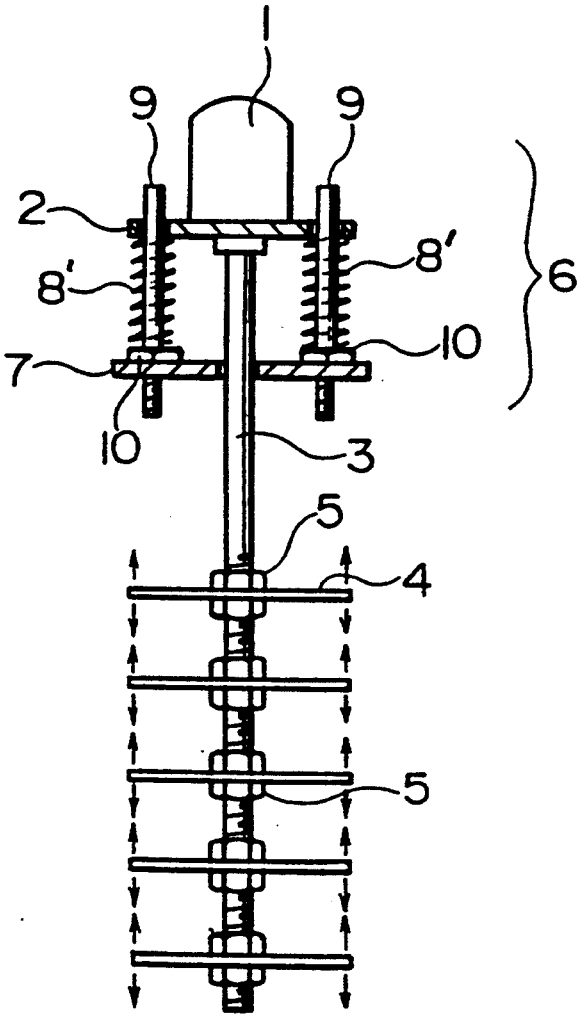
FIG. 18 is a plain front illustrating another example of the oscillation absorbing member.

In the oscillation absorption mechanism 6, springs 8 are inserted between a base plate 7 and the base plate 2 and guide shafts 9 fixed on the base plate 7 for the purpose of precluding lateral slide are slidably pierced through the base plate 2 and adapted to guide the base plate 2. Shock absorbers such as of rubber may be used in FIG. 18 in the place of the springs 8. In this case, the guide shafts 9 and the shock absorbers must be disposed at different positions. Denoted by 10 are bolts which are helically inserted downwardly into the base plate 7 from above for the purpose of fixing the base plate 7 on a supporting base 12 in the opening part of the container.

Figure 9:
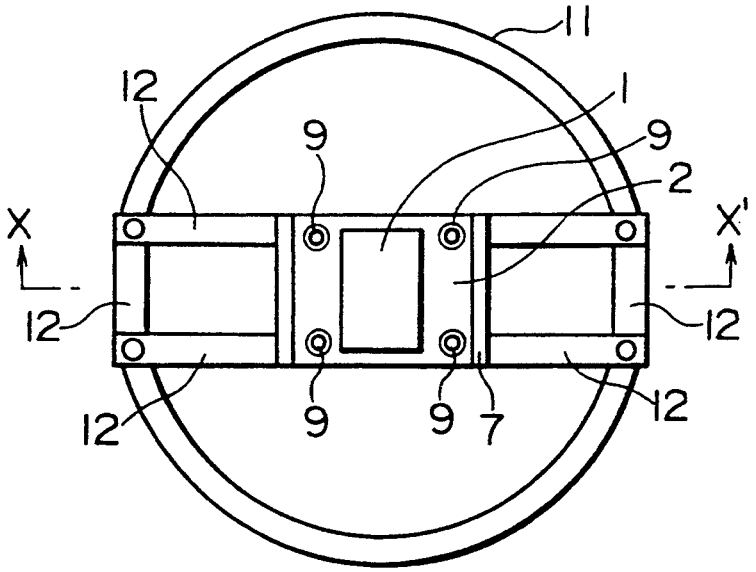
FIG. 9 is a plan view illustrating one example of the attachment to a container of the apparatus for mixture and dispersion as one embodiment of this invention.
Figure 10:
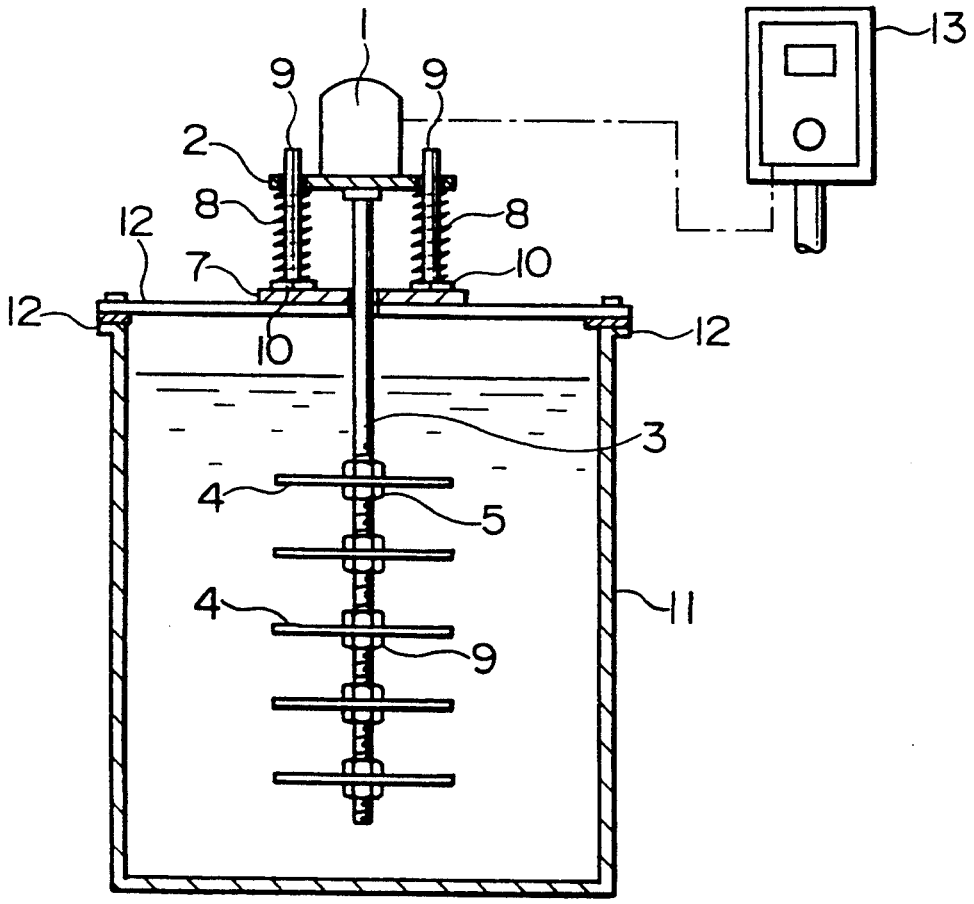
FIG. 10 is a front view of the illustration of FIG. 9.

FIG. 9 is a plan view illustrating an example of the attachment of the apparatus for mixture and dispersion shown in FIG. to the container and FIG. 10 is a front view of the illustration of FIG. 9.

This example represents the state in which the apparatus for mixture and dispersion illustrated in FIG. 1 is attached to a cylindrical tank 11 having an upper opening part. The tank 11 contains a liquid (for synthetic resin) and a powder.

In the diagram, 12 stands for a supporting base for enabling the aforementioned apparatus for mixture and dispersion to be supported in place in the upper opening part 11*a* of the cylindrical tank 11. Denoted by 13 is a transistor inverter which is intended to control the frequency, i.e. the number of oscillations generated by the oscillation motor 1. Though the frequency in the range of 10 to 40 Hz is generally adopted, the present example uses a frequency in the range of 20 to 30 Hz.

The tank 11 is isolated from the energy of the oscillation of the oscillation motor 1 as a result of the oscillation absorption mechanism 6. This energy is transmitted from the oscillation shaft 3 to the fluid composed of liquid and powder through the medium of the oscillation vanes 4 and is spent to effect desired mixture and dispersion.

The oscillation motor 1 has a small tightly closed structure and is enabled to operate for 5,000 hours without requiring lubrication under ordinary load. The apparatus for mixture and dispersion according to this invention, therefore, has only small load and develops mechanical trouble sparingly.

In contrast to the conventional rotary stirring apparatus which causes a given fluid to revolve as a whirlpool and produces different motions in the central part and the peripheral part of the apparatus, the apparatus for mixture and dispersion according with this invention accomplishes required mixture and dispersion of a fluid in a container by virtue of the oscillation and, as a result, homogeneously mixes the fluid throughout the entire volume thereof and ensures production of a homogeneously mixed and dispersed mixture When the speed of mixture and dispersion for the production of a coating material by the use of the apparatus of this invention is compared with the speed of mixture and dispersion obtained by the use of the conventional rotary stirring apparatus, the former is higher than the latter and the time required by the former apparatus, therefore, is about one half of that which is required by the latter apparatus.

In contrast to the rotary stirring device which allows persistence of coarse secondary particles and inevitably requires additional use of a separate dispersing device for the purpose of producing a satisfactory coating material, the apparatus for mixture and dispersion according to this invention produces a mixture of particles minute enough to be discharged through a sprayer and dispersed to a fineness gauge reading of about 8 and, therefore, obviates the necessity for additionally using a separate dispersing device.

The conventional rotary mixing device is incapable of conveniently mixing two or more species of powder. In contrast thereto, the apparatus for mixture and dispersion in accordance with the present invention is effective in mixing two or more species of powder.

The coating material diluted and stirred by the conventional rotary stirring device for application by electrodeposition produces slight sediment in the lower part of the device in a span of one day, whereas the coating material mixed and dispersed by the apparatus for mixture and dispersion according to this invention remains in a suspended state without inducing any sedimentation in the lower part of the apparatus and manifests an ample coating property without causing any alteration in the composition.

The apparatus for mixture and dispersion according to this invention can be applied not only to the mixture of two species of liquid such as, for example, a resin solution and a solvent, but also to the mixture of liquid and powder (such as resin, pigment, additive, etc.), and the mixture of two species of powder and even to the solution of solid in liquid.

This apparatus can also be used as a small laboratory grade dispersion device and can be easily applied to a large tank. Moreover, the apparatus for mixture and dispersion in accordance with the present invention has high mobility.

Generally, a degreaser containing a surfactant is used for removing oil or grease adhering to metals or resins. For the sake of this removal, it is desirable to establish ample contact efficiently between the degreaser and an object under treatment. In this case, the rotary stirring device cannot be used because it compels the components being stirred to foam or the degreasing by boiling consumes as much time as about 30 minutes for thorough removal of the oil. When the combination of oscillation, flow, and agitation is effected by the use of the apparatus for mixture and dispersion according to this invention, the removal of oil is efficiently completed in a matter of about five minutes without entailing the phenomenon of foaming. The life of the degreaser used in this case is approximately doubled.

Figure 11:
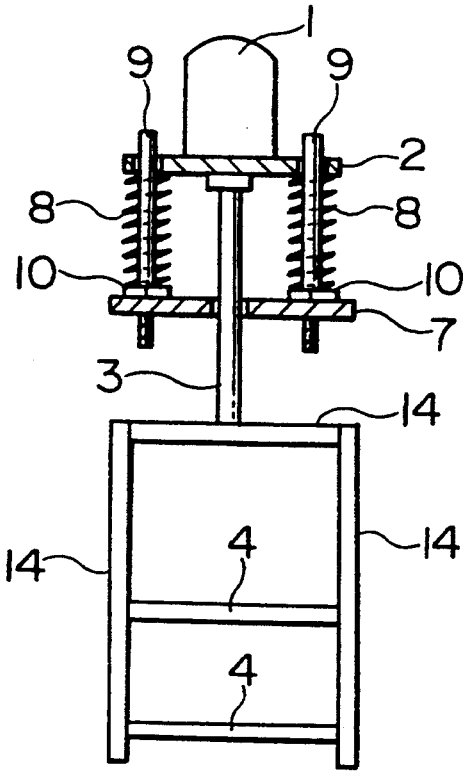
FIG. 11 is a front view of an apparatus for mixture and dispersion as another embodiment of this invention.
Figure 12:
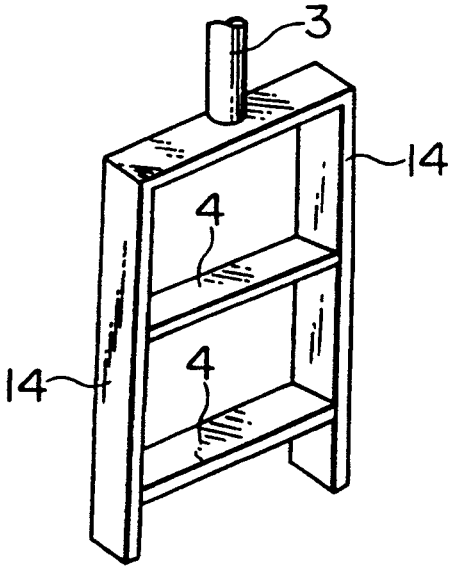
FIG. 12 is a perspective view of a framework illustrated in FIG. 11.

Now, another working example of this invention will be described below. FIG. 11 is a front view of an apparatus for mixture and dispersion in the present example and FIG. 12 is a partial perspective view of the apparatus illustrated in FIG. 11. As shown in these diagrams, the apparatus for mixture and dispersion according to this invention may be provided at the leading end of the oscillation shaft 3 with a framework 14 of the shape of three sides of a square and in the framework 11 with an oscillation vane 4 made of a metal.

Incidentally, this oscillation vane 4 may be disposed either horizontally or obliquely between the parallel shanks of the framework 14 of the shape of three sides of a square which is attached to the leading end of the oscillation shaft 3.

Figure 13:
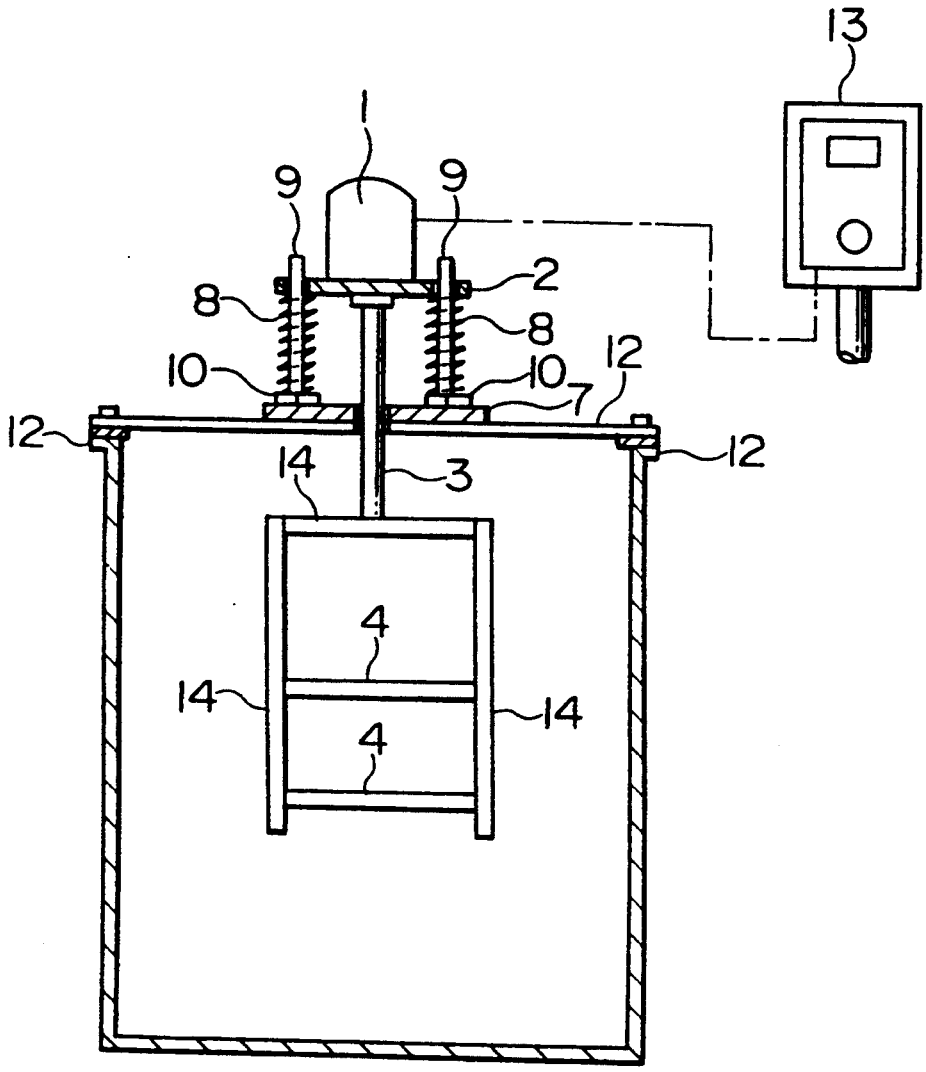
FIG. 13 is a front view illustrating another example of the attachment to the container of the apparatus for mixture and dispersion illustrated in FIG. 11.

FIG. 13 illustrates an example of the attachment of the apparatus for mixture and dispersion illustrated in FIG. 12 to the cylindrical tank 11 having an upper open end. The means for effecting this attachment is the same as that which is shown in FIG. 9 and FIG. 10.

When the same test was carried out in this example as in the working example first cited above, it yielded ideal results.

Then, the following experiment was performed for the purpose of comparing the conventional rotary vane stirring device and the apparatus for mixture and dispersion according to this invention regarding the consumption of time and electric power for the mixing and dispersing operations.

When a solution of 5% of slaked lime in water prepared in a cylindrical container having an inner volume of 2 $m^3$ was stirred with the conventional rotary vane stirring device (motor output 0.7 kW) for 10 minutes, solids persisted in the bottom of the container, indicating no thorough mixture or dispersion was obtained. When an apparatus for mixture and dispersion according to this invention (provided with two stages of oscillation vanes and an oscillation motor of output 65 W) was operated for three minutes in a solution of 5% of slaked lime in water prepared in a cylindrical container having an inner volume of 2 $m^3$, thorough mixture and dispersion was obtained as evinced by from the bottom of the container being essentially devoid of solids It has been confirmed by the results shown above that the use of the apparatus for mixture and dispersion according to this invention notably decreases the time required for mixture and dispersion and conspicuously cuts the electric power consumption.

It should be noted that this invention is not limited to the working examples cited above.

Figure 14:
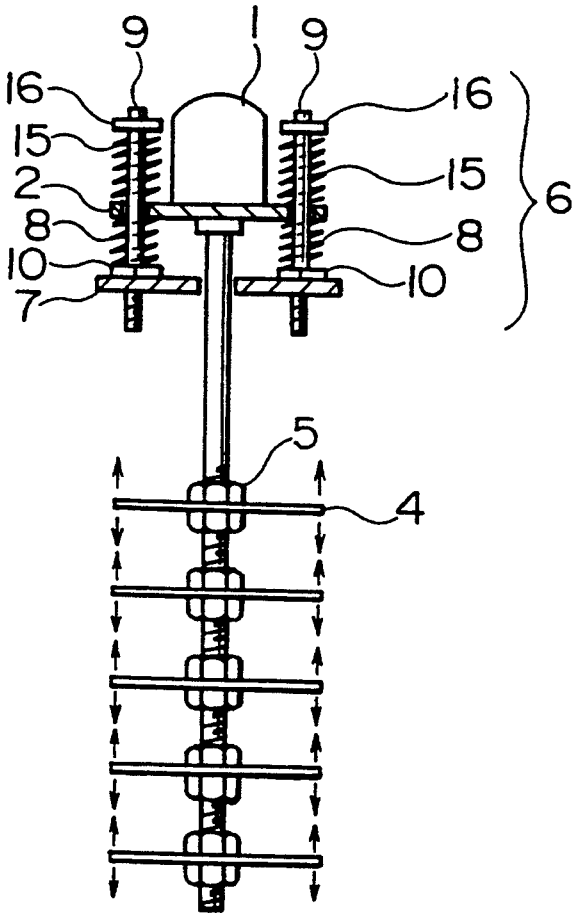
FIG. 14 is a front view of an apparatus for mixture and dispersion as yet another embodiment of this invention.

In the oscillation absorption mechanism 6, for example, the springs 8 may be interposed between the base plate 7 and the base plate 2; the guide shafts 9 fixed on the base plate 7 for preventing lateral slip may be slidably pierced through the base plate 2 and adapted to guide the base plate 2; and springs 15 disposed on the base plate 2 along the guide shafts 9 may be adapted to produce a depressing force as illustrated in FIG. 14. In this case, the springs 15 are fixed with nuts 16 which are fastened at the upper ends thereof. As a result, the oscillation transmission efficiency from an oscillation motor 1 is further increased. In addition, noise generated from oscillation was significantly reduced. The oscillation stirring effect was increased by about 20% as compared with the apparatus of the first embodiment.

Figure 15:
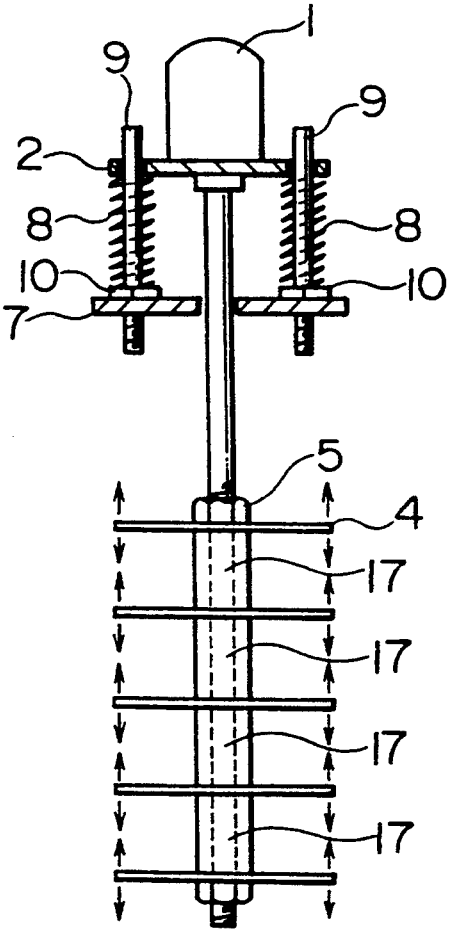
FIG. 15 is a front view of an apparatus for mixture and dispersion as still another embodiment of this invention.

The intervals between the adjacent oscillation vanes 4 may be fixed by interposing spacers 17 therebetween as illustrated in FIG. 15.

Figure 16:
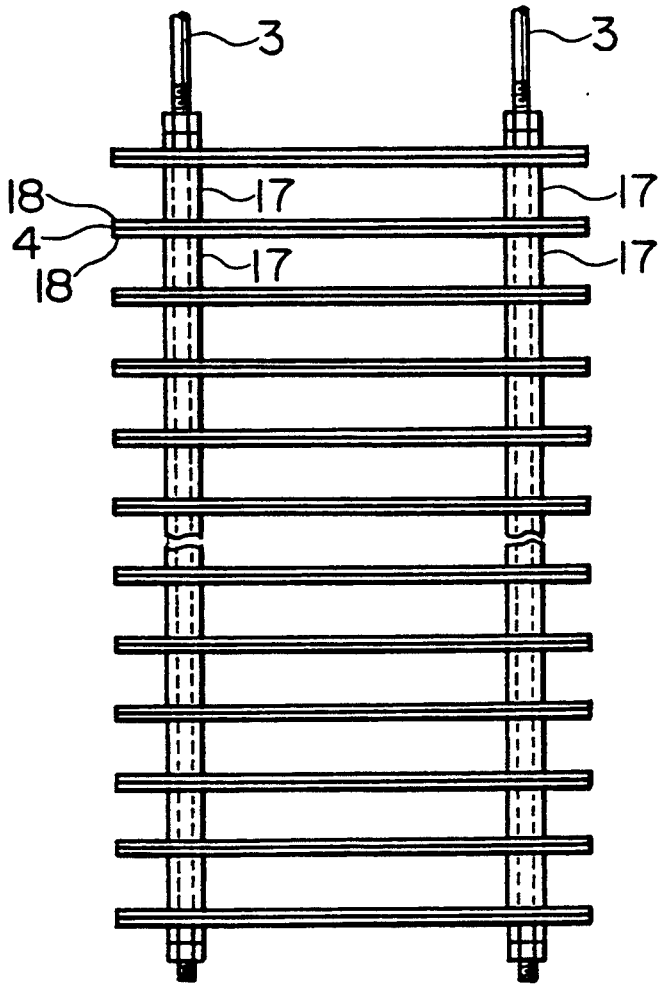
FIG. 16 is a front view of an apparatus for mixture and dispersion as a further embodiment of this invention.
Figure 17:
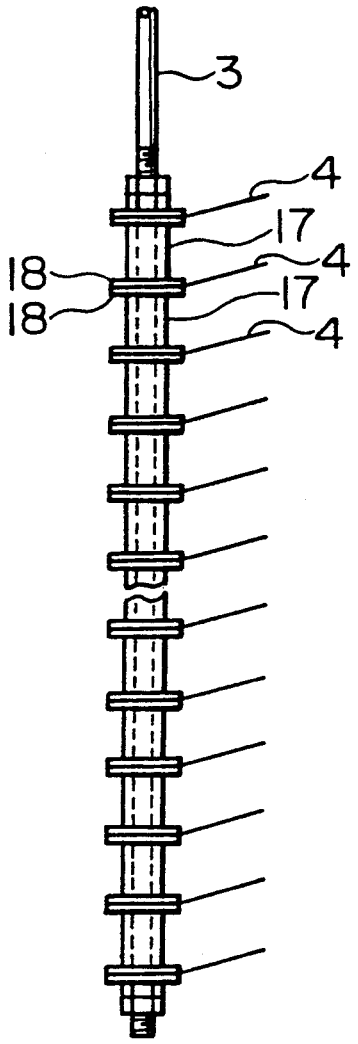
FIG. 17 is a side elevation of the apparatus for mixture and dispersion illustrated in FIG. 16.

When the oscillation vanes 4 have a very small thickness (about 0.20 to 0.25 mm), they may be constructed as illustrated in FIG. 16 and FIG. 17. Spacers 17 are inserted around two oscillation shafts 3 (connected jointly to one motor). Two plates 18 are nipped between the adjacent spacers 17. These plates 18 are placed taut between the two oscillation shafts 3. The oscillation vanes 4 are each nipped between the adjacent plates 18. In this construction, the oscillation vanes 4 are inclined by about 15 degrees. When the oscillation vanes 4 are very thin, the effect of mixture by the fluttering of the oscillation vanes is conspicuously increased. For example, the results obtained by the oscillation motor of a capacity of 125 W in the working example cited above are obtained in the present working example by the use of an oscillation motor rated for 75 W.

It is clearly noted from the description given thus far that the apparatus for mixture and dispersion according to this invention brings about the following effects as compared with the conventional rotary vane stirring device.

When the apparatus for mixture and dispersion according to the present invention is used, uniform mixture and dispersion is consistently effected and no early separation of the components of the produced mixture occurs after completion of the mixing and dispersing operation. Essentially no sediment occurs in the bottom of the container because the mixture and dispersion effectively proceeds throughout the entire inner volume of the container. Thus, the motive power required for the mixture and dispersion is extremely small and no adverse chemical effect is exerted on the fluid under treatment. Even when the mixture is carried out between two species of powder, the mixture and dispersion can be consistently effected and the necessity for checking the amount of the fluid for the sake of preventing idle rotation is obviated. Moreover, the time required for the mixture and dispersion is very short and the electric power required for the operation is small. Even when the tank holding the fluid is large, use of one apparatus for mixture and dispersion suffices to attain required mixture and dispersion and no use is found for the provision of a special member such as a baffle plate on the inner wall of the container.

What is claimed is:

1. An apparatus for mixing and dispersing a fluid in a container, said apparatus comprising an oscillation generating device for generating oscillation, an oscillation shaft for transmitting the oscillation generated by said oscillation generating device in an axial direction, at least one oscillation vane fixed on said oscillation shaft and adapted to vibrate as a result of the force of the oscillation of said oscillation shaft, and an oscillation absorbing mechanism interposed between said oscillation generating device and a container.

2. The apparatus according to claim 1, wherein said oscillation generating device comprises an oscillation motor and an inverter for controlling a number of oscillations generated by said oscillation motor.

3. The apparatus according to claim 1, wherein said oscillation vanes comprise a circular shape.

4. The apparatus according to claim 1, wherein said oscillation vanes comprise a shape of a polygon of at least three sides.

5. The apparatus according to claim 1, wherein said oscillation vanes comprise a plurality of substantially equal parts.

6. The apparatus according to claim 1, wherein said oscillation vanes are each disposed on a plane perpendicularly intersecting said oscillation shaft.

7. The apparatus according to claim 1, wherein said oscillation vanes are disposed on planes forming an angle in the range of about 5 degrees to about 30 degrees with a plane perpendicularly intersecting said oscillation shaft.

8. The apparatus according to claim 1, wherein said oscillation vanes have a thickness in the range of about 0.2 mm. to about 2 mm.

9. The apparatus according to claim 1, wherein said at least one oscillation vane comprise a plurality of oscillation vanes, and further, comprising spacers interposed between said oscillation vanes.

10. The apparatus according to claim 9, wherein said spacers are around said oscillation shaft.

11. The apparatus according to claim 1, wherein said oscillation shaft comprises a framework fixed to a leading terminal of the oscillation shaft, and said oscillation vanes are fixed to said framework in such a manner as to lie within said framework.

12. The apparatus according to claim 1, wherein said oscillation absorption mechanism comprises a supporting base disposed in an opening part of said container and an oscillation absorbing member supported on said supporting base and adapted to support said oscillation generating device on said oscillation absorbing member.

13. The apparatus according to claim 12, wherein said oscillation absorbing member comprises a spring member.

14. The apparatus according to claim 12, wherein said oscillation absorbing member comprises a rubber member.

15. The apparatus according to claim 1, wherein frequency of oscillation generated by said oscillation generating device is in the range of about 10 Hz. to about 40 Hz.

16. An oscillation absorption apparatus comprising: a supporting base, an oscillation absorbing member supported on said supporting base, and an oscillation generating device comprising a transistor inverter supported on said oscillation absorbing member.

17. A mixing apparatus comprising an oscillation shaft comprising at least one oscillation vane having a predetermined shape, said oscillation vane comprising a plurality of sectional plates defining said predetermined shape.

18. An apparatus for mixing and dispersing a fluid in a container, said apparatus comprising:

an oscillation generating device for generating oscillation;

an oscillation shaft for transmitting the oscillation generated by said oscillation generating device in an axial direction;

at least one oscillation vane fixed on said oscillation shaft and adapted to vibrate as a result of the oscillation of said oscillation shaft; and an oscillation absorbing mechanism interposed between said oscillation generating device and a container, said oscillation absorbing mechanism comprising:

a supporting base disposed in an opening part of said container;

a first oscillation absorbing member fixed fast on said supporting base and adapted to support said oscillation generating device on said oscillation absorbing member; and a second oscillation absorbing member adapted to impart elastic force from above said oscillation generating device mounted on said first oscillation absorbing member in the direction of said first oscillation absorbing member.

19. The apparatus according to claim 18, wherein said first and second oscillation absorbing members both comprise a spring member.

20. The apparatus according to claim 18, wherein said first and second oscillation absorbing member both comprise a rubber member.

21. An apparatus for mixing and dispersing a fluid in a container, said apparatus comprising:

an oscillation generating device comprising a transistor inverter for generating oscillation in the range of about 10 Hz to about 40 Hz;

an oscillation shaft for transmitting the oscillation generated by said oscillation generating device in an axial direction;

at least two oscillation vanes fixed on said oscillation shaft and adapted to vibrate as a result of the oscillation of said oscillation shaft; and an oscillation absorbing mechanism interposed between said oscillation generating device and a container.

* * * * *

UNITED STATES PATENT AND TRADEMARK OFFICE

CERTIFICATE OF CORRECTION

PATENT NO. : 5,375,926

DATED : Dec. 27, 1994

INVENTOR(S) : Ryushin Omasa

It is certified that error appears in the above-indentified patent and that said Letters Patent is hereby corrected as shown below:

On title page, item [54], and col. 1,

In the Title: The word "DISPENSING" should be "DISPERSING".

Signed and Sealed this

Second Day of January, 1996

Bruce Lehman

*Attest:*

BRUCE LEHMAN

*Attesting Officer*

*Commissioner of Patents and Trademarks*